United States Patent [19]

Tsai

[11] Patent Number: 4,658,456

[45] Date of Patent: Apr. 21, 1987

[54] MULTI-PURPOSE SCISSORS

[76] Inventor: Su-Jem Tsai, No. 90, Su Yeh Road, Cheng District, Kaohsiung, Taiwan

[21] Appl. No.: 788,128

[22] Filed: Oct. 16, 1985

[51] Int. Cl.[4] ..... B25F 1/00; B25B 7/22

[52] U.S. Cl. ..... 7/135; 7/137; 7/151

[58] Field of Search ..... 7/151, 135, 137, 143, 7/165, 170; 81/394

[56] References Cited

U.S. PATENT DOCUMENTS

| | | | |
|---|---|---|---|
| 553,579 | 1/1896 | Frye | 7/135 |
| 667,914 | 2/1901 | Klever | 7/135 |
| 918,672 | 4/1909 | Hansen | 7/135 |
| 1,889,556 | 11/1932 | Lane | 81/394 |
| 2,778,254 | 1/1957 | Carapellotti | 7/135 |

FOREIGN PATENT DOCUMENTS

| | | | |
|---|---|---|---|
| 1064990 | 12/1953 | France | 81/394 |

*Primary Examiner*—Roscoe V. Parker

*Attorney, Agent, or Firm*—Robert B. Frailey

[57] ABSTRACT

A multi-purpose scissors which comprises a pair of first and second bodies which are pivotally connected by a detachable rivet or the like. The detachable rivet is arranged to be capable of being fixed to either one of a pair of positioning holes formed in the first body so that this can increase the relative movement of the first and second bodies hence to provide a more flexible function for the users. The first and second bodies are provided with a plurality of commonly used tools therefore it is a practical multi-purpose scissors.

1 Claim, 9 Drawing Figures

MULTI-PURPOSE SCISSORS

BACKGROUND OF THE INVENTION

This invention relates to a multi-purpose scissors.

Conventional multi-purpose scissors mainly comprises a pair of bodies which are pivotally connected to each other by means of a rivet or the like. However, said rivet is arranged to be fixed to a predetermined position thereby the relative movement between said two bodies is restricted so that it can not provide significant effects for the users. Besides, the tools disposed on said conventional multi-purpose scissors are somewhat limited therefore need be increased.

It is, therefore, an object of the present invention to obviate and mitigate the above-noted drawbacks.

SUMMARY OF THE INVENTION

It is the primary object of the present invention to provide a multi-purpose scissors wherein a first body is pivotally connected to a second body by means of a detachable rivet or the like and said rivet is arranged to be capable of being fixed to either one of a pair of positioning holes formed in said first body therefore it can increase the relative movement of said first and second bodies hence to provide a more flexible use.

It is another object of the present invention to provide a multi-purpose scissors wherein a plurality of commonly used tools are integrally formed with a single scissors.

It is still another object of the present invention to provide a multi-purpose scissors which is practical for use.

It is a further object of the present invention to provide a multi-purpose scissors which is easy to fabricate.

BRIEF DESCRIPTION OF THE DRAWINGS

FIG. 3-1 is a local perspective view thereof showing the head member capable of being secured to the second body of the present invention to be served as a hammer;

FIG. 3-2 is a cross-sectional view taken along the line A—A of FIG. 3-1; and FIG. 4-1 illustrates a detachable rivet together with a washer of a preferred embodiment of the present invention;

FIG. 4-2 shows the first and second bodies being pivotally joined each other by the detachable rivet and the washer.

DETAILED DESCRIPTION OF THE PREFERRED EMBODIMENT

Figure 1:
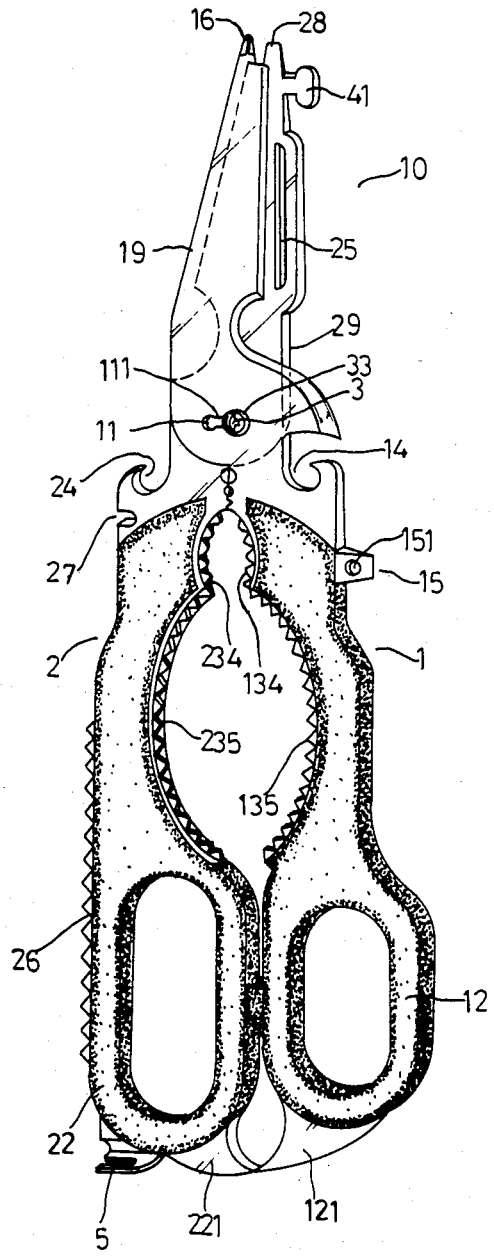
FIG. 1 is a perspective view of a preferred embodiment of the present invention.
Figures 2, 2A, 2B:
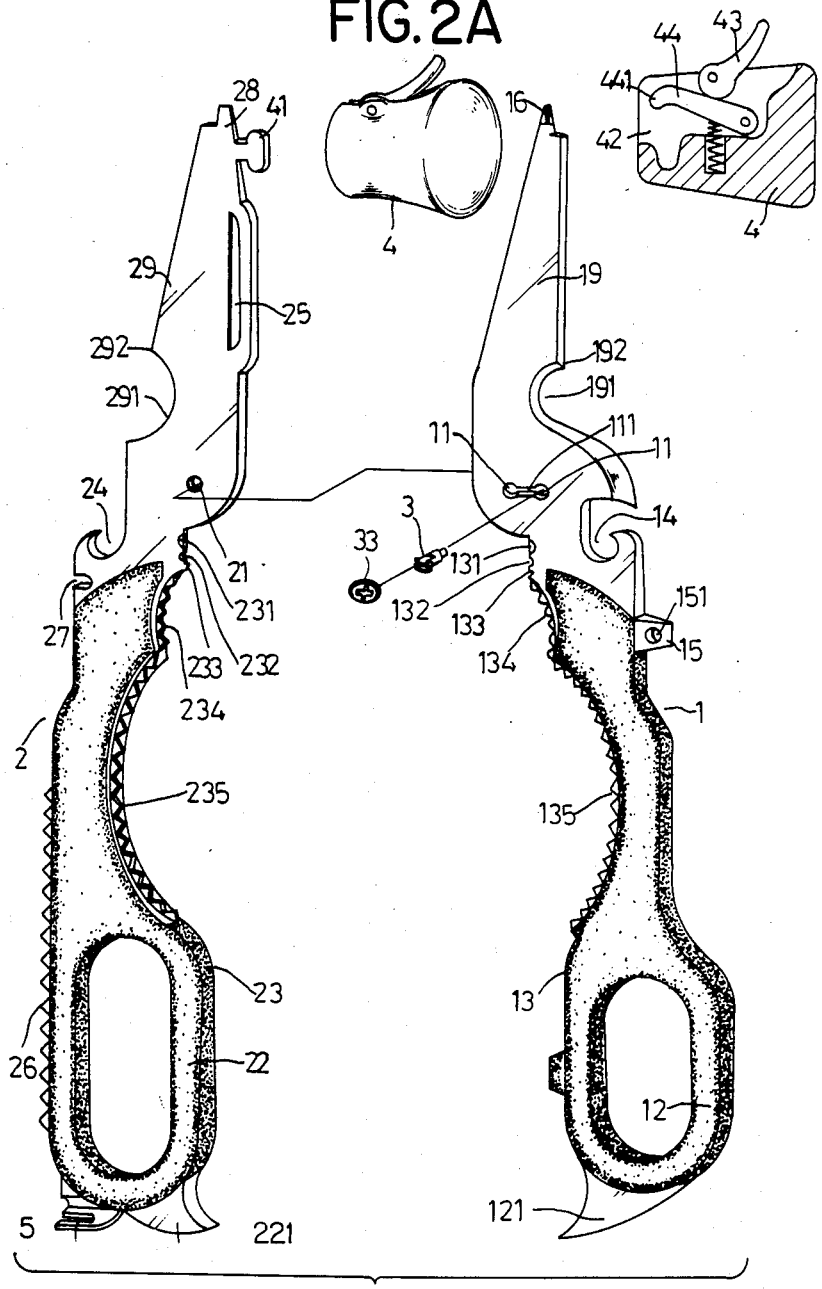
FIG. 2 is a fragmentary perspective view of FIG. 1 wherein a head member can be secured to the present invention.

Referring to the drawings and particularly to FIGS. 1 and 2, a multi-purpose scissors (10) comprises a pair of first and second bodies (1) and (2). The first body (1) is provided at the middle portion with a pair of aligned positioning holes (11) communicated by a somewhat narrower slot (111) while the second body (2) is furnished with a fixing hole (21) corresponding to either one of said positioning holes (11).

Figure 4A:
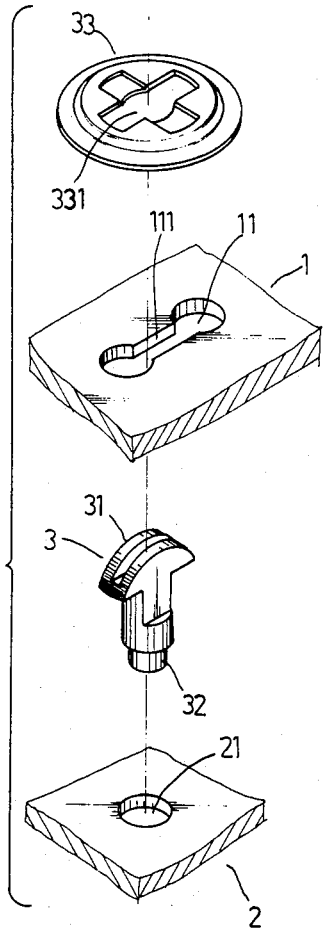
Figure 4B:
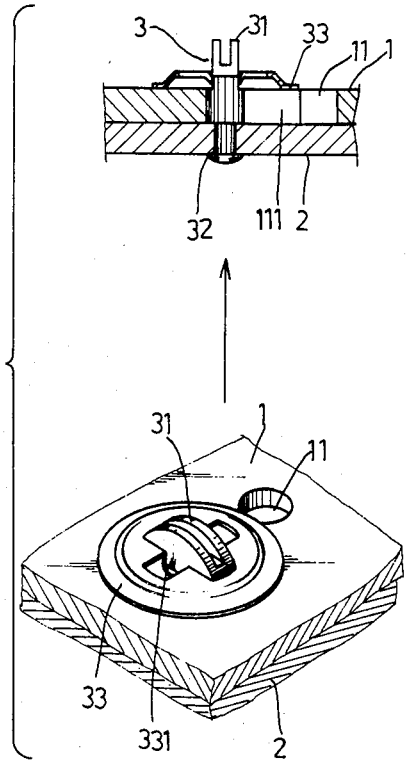

Referring to FIG. 4-1, a detachable rivet (3) is provided with an enlarged end (31) corresponding to the slot (111) of the first body (1) and with a smaller end (32) corresponding to the fixing hole (21) of the second body (2). A washer (33) is formed with a slot (331) which corresponds to the enlarged end (31) of the detachable rivet (3).

Referring to FIG. 4-2, the first and second bodies (1) and (2) are pivotally connected each other in such a manner that the smaller end (32) of the rivet (3) passes through the fixing hole (21) of the second body (2) to be rivetted thereto while the enlarged end (31) thereof passes through the slot (111) of the first body (1), the slot (331) of the washer (33) and then rotates at an angle 90° to fixedly engage with the washer (33) thereof. It is noted that the rivet (3) can be fixed to either one of the positioning holes (11) of the first body (1) thereby making the relative movement of the first and second bodies (1) and (2) more flexible.

The lower end of the first body (1) is formed with a handle (12) of which the bottom side has a portion (121) while the lower end of the second body (2) is provided with a handle (22) of which the bottom side is formed with a portion (221) which is cooperated with the portion (121) of the first body (1) to be served as a hair pincer.

Figure 5:
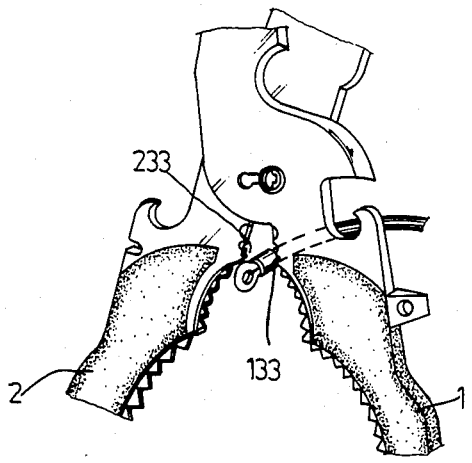
FIGS. 5 to 7 show some practical applications of the present invention.

The opposite two inner sides (13) (23) of the first and second bodies (1) and (2) are respectively provided with wire cutting means (131) and (231) to be served as a wire cutter, wire stripping means (132) and (232) to be served as a wire stripper, a recess (133) and a flange (233) to secure a connector to an electric wire (FIG. 5), saw-toothed portions (134) and (234) to be served as a plier for smaller objects and saw-toothed portions (135) and (235) to be served as a plier for larger objects.

Figure 6:
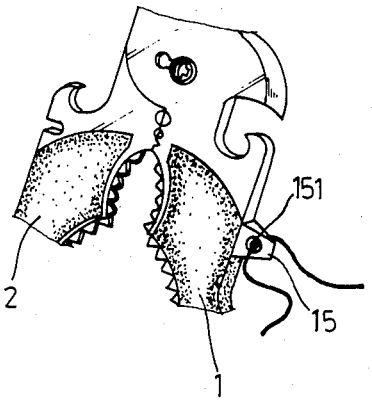

The outer side of the first body (1) is formed with a can opener (14) and a screw driver (15) having a hole (151) disposed thereon for bending a wire (FIG. 6). The upper end of the first body (1) is formed with a Phillips-head screwdriver (16).

Figure 7:
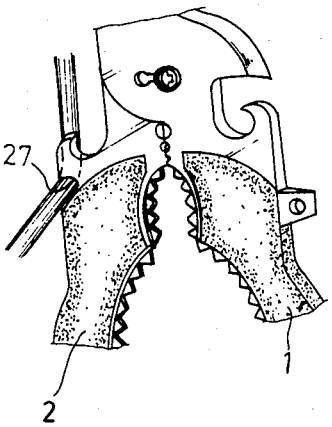

The outer side of the second body (2) is provided with a bottle opener (24), a scale scraper (26) and a wire bending means (27) for bending the wire (FIG. 7). The second body (2) is furnished at the upper end with a standard screwdriver (28).

The upper portions of the first and second bodies (1) and (2) are respectively provided with blades (19) and (29) corresponding to each other to be served as a scissors. The first and second bodies (1) and (2) are further provided with portions (191) and (291) each having a knife edge (192) and (292) to form a nut cracker. Furthermore, the second body (2) is provided at the upper inner side with a peeling means (25).

Additionally, the second body (2) is formed at the top with a flange (41) to which a head member (4) can be secured to be served as a hammer. The bottom end of the second body (2) is provided with a claw (5) which is used to pull a nail out of an object.

Figure 3A:
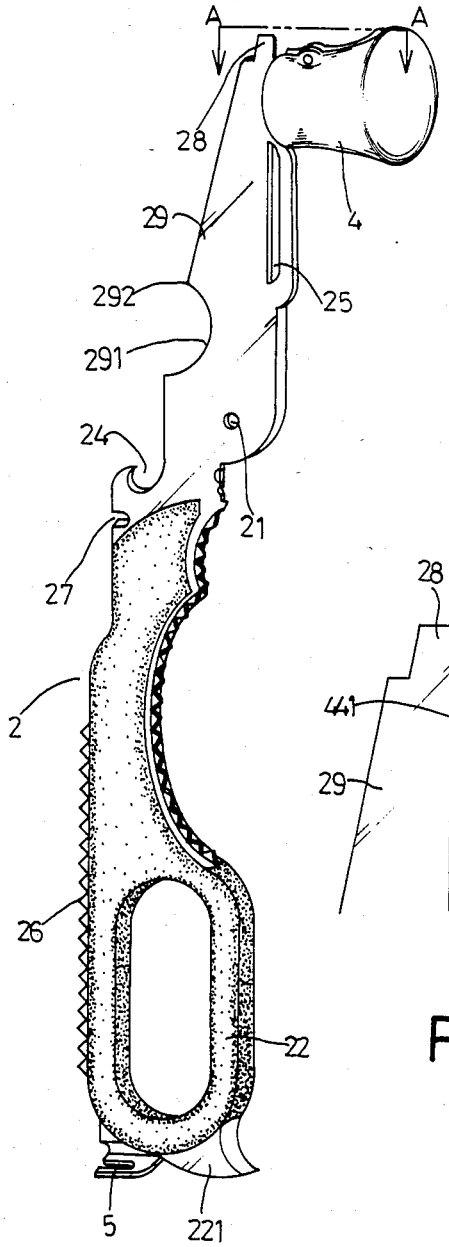
Figure 3B:
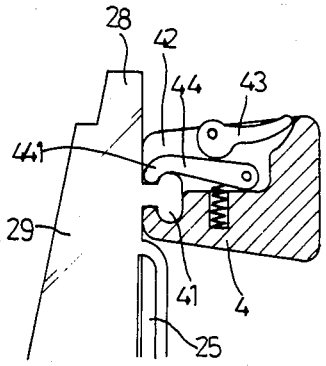

Referring to FIGS. 2, 3-1 and 3-2, the head member (4) is provided in the interior with a recess (42) which corresponds to the flange (41) of the second body (2). A cam member (43) is pivotally disposed in said recess (42) to cooperate with a spring-loaded fixing rod (44) which is provided at one end with a hook portion (441) and is pivotally disposed at the other end in the recess (42) of the head member (4). Thus the head member (4) can be secured to the second body (2) with the flange (41) of the second body (2) being received in said recess (42)

and engaged with the hook portion (441) of the fixing rod (44).

I claim:

1. A multi-purpose scissors comprising:

a first body being provided at the middle portion with a pair of aligned positioning holes communicated by a slot, the lower end of the first body being formed with a handle of which the bottom side has a first portion, the inner side of the first body being provided with a wire cutting means, a wire stripping means, a recess, a smaller saw-toothed portion and a larger saw-toothed portion, the outer side of the first body being formed with a can opener and a screw driver having a hole disposed thereon for bending a wire, the upper end of the first body being formed with a Phillips-head screwdriver, the upper outer portion of the first body being provided with blade and a second portion having a knife edge;

a second body being furnished at the middle portion with a fixing hole corresponding to either one of the positioning holes of the first body, the second body being pivotally connected to the first body by means of a detachable rivet or other suitable means such that the rivet thereof can be fixed to either one of the two positioning holes to make the relative movement of the first and second bodies more flexible, the lower end of the second body being provided with a handle of which the bottom side is formed with a first portion which is cooperated with the first portion of the first body to form a hair pincer, the inner side of the second body being provided with a wire cutting means corresponding to the wire cutting means of the first body to form a wire cutter, a wire stripping means corresponding to the wire stripping means of the first body to form a wire stripper, a flange corresponding to the recess of the first body to secure a connector to an electric wire, a smaller saw-toothed portion corresponding to the smaller saw-toothed portion of the first body to form a plier for smaller objects and a larger saw-toothed portion corresponding to the larger saw-toothed portion of the first body to form a plier for larger objects, the outer side of the second body being formed with a bottle opener, a scale scraper and a wire bending means for bending the wire, the second body being furnished at the upper end with a standard screwdriver, the upper inner portion of the second body being provided with a protuberance and a peeling means, the upper outer portion of the second body being furnished with blade corresponding to the blade of the first body to be served as a scissors and a second portion having a knife edge corresponding to the second portion of the first body to form a nut cracker, the bottom end of the second body being provided with a claw which is used to pull a nail out of an object;

a head member capable of being engaged with the protuberance of the second body to be served as a hammer.

* * * * *